US011403978B2

(12) United States Patent
Liu et al.

(10) Patent No.: US 11,403,978 B2
(45) Date of Patent: Aug. 2, 2022

(54) CHIP PROGRAMMING VOLTAGE DETECTION CIRCUIT AND DETECTION METHOD

(71) Applicants: CHENGDU BOE OPTOELECTRONICS TECHNOLOGY CO., LTD., Chengdu (CN); BOE TECHNOLOGY GROUP CO., LTD., Beijing (CN)

(72) Inventors: Lixia Liu, Beijing (CN); Jianjun Li, Beijing (CN); Tianma Li, Beijing (CN); Bin Ji, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/003,942

(22) Filed: Aug. 26, 2020

(65) Prior Publication Data

US 2021/0150951 A1 May 20, 2021

(30) Foreign Application Priority Data

Nov. 20, 2019 (CN) ..... 201922027328.3

(51) Int. Cl.
*G09G 3/00* (2006.01)

(52) U.S. Cl.
CPC ..... *G09G 3/006* (2013.01); *G09G 2330/02* (2013.01)

(58) Field of Classification Search
CPC ..... G09G 3/006; G09G 2330/02; G09G 2300/0408
See application file for complete search history.

(56) References Cited

U.S. PATENT DOCUMENTS

2006/0114631 A1* 6/2006 Li ..... G01R 31/319 361/90
2009/0167247 A1* 7/2009 Bai ..... H02J 7/0016 320/134
2011/0249476 A1* 10/2011 Chen ..... H02H 1/0007 363/52
2015/0049072 A1* 2/2015 Eggert ..... G09G 3/006 345/211

* cited by examiner

*Primary Examiner* — Mark W Regn
(74) *Attorney, Agent, or Firm* — Kinney & Lange, P.A.

(57) ABSTRACT

A chip programming voltage detection circuit and a chip programming voltage detection method are disclosed. The chip programming voltage detection circuit comprises a detection subcircuit and a warning subcircuit. The detection subcircuit detects a voltage at a programming voltage output pin, and outputs a detection signal based on the voltage at the programming voltage output pin. The warning subcircuit is connected to a detection output terminal of the detection subcircuit, and is operated to issue a warning alarm in a case where the detection signal indicates that the voltage at the programming voltage output pin does not reach a voltage required for an IC chip programming.

12 Claims, 3 Drawing Sheets

CHIP PROGRAMMING VOLTAGE DETECTION CIRCUIT AND DETECTION METHOD

CROSS-REFERENCE TO RELATED APPLICATION

This application claims priority of Chinese Patent Application No. 201922027328.3, filed on Nov. 20, 2019, the disclosure of which is incorporated herein by reference in its entirety.

TECHNICAL FIELD

The present disclosure relates to the field of chip programming, and in particular, to a chip programming voltage detection circuit and a chip programming voltage detection method.

BACKGROUND

In a production process of TFT-LCD module products, it is necessary to apply a programming voltage to IC chips in the product to perform IC chip programming, so as to complete an adjustment and correction of some parameters. Before the IC chip is programmed, it is necessary to detect whether the programming voltage applied to the IC chip meets programming requirements, so as to avoid a problem of programming failure or IC chip damage, due to the programming voltage applied to the IC chip does not meet programming requirements.

SUMMARY

The present disclosure provides a chip programming voltage detection circuit applied to an IC chip that comprises a programming voltage output pin, comprising:

a detection subcircuit comprising a detection input terminal connected to the programming voltage output pin of the IC chip and a detection output terminal, and operated to detect a voltage at the programming voltage output pin through the detection input terminal, and output a detection signal through the detection output terminal based on the voltage at the programming voltage output pin, the detection signal indicating whether the voltage at the programming voltage output pin reaches a voltage required for an IC chip programming; and a warning subcircuit connected to the detection output terminal of the detection subcircuit, and operated to receive the detection signal output by the detection subcircuit and issue a warning alarm in a case where the detection signal indicates that the voltage at the programming voltage output pin does not reach the voltage required for an IC chip programming.

Further, the chip programming voltage detection circuit is provided on a lighting fixture pluggable with a driving circuit board for the IC chip, the IC chip being connected to the driving circuit board.

Further, the detection subcircuit comprises a voltage comparison circuit connected to the programming voltage output pin, and configured to compare the voltage at the programming voltage output pin with a reference voltage.

Further, the voltage comparison circuit comprises:

a reference voltage circuit that provides the reference voltage; and a comparator having a first input terminal connected to the programming voltage output pin, a second input terminal connected to the reference voltage circuit, and an output terminal serving as the detection output terminal to output the detection signal.

Further, the detection subcircuit further comprises a first divider resistor and a second divider resistor connected in series between the programming voltage output pin and a ground terminal, a node between the first divider resistor and the second divider resistor being connected to the first input terminal of the comparator.

Further, the reference voltage is determined according to the following equation:

$$V\text{ref}=V1*(R2/(R1+R2))$$

in which, Vref represents the reference voltage, V1 represents the voltage required for an IC chip programming, R1 represents resistance of the first divider resistor, and R2 represents resistance of the second divider resistor.

Further, the comparator is further configured to output the detection signal with a first level to enable the warning subcircuit to issue the warning alarm in a case where the voltage at the programming voltage output pin is smaller than the reference voltage.

Further, the reference voltage circuit comprises:

a DC power supply configured to provide a DC supply voltage to a Zener diode; and the Zener diode having a cathode connected to the DC power supply and the second input terminal of the comparator and an anode connected to a ground terminal.

Further, the warning subcircuit comprises:

a switch circuit having an input terminal connected to the detection output terminal of the detection subcircuit and a power supply terminal, and configured to receive the detection signal and be turned on under control of the detection signal to provide a supply voltage of the power supply terminal to a warner; and the warner connected to an output terminal of the switch circuit, and configured to issue the warning alarm under control of the switch circuit.

Further, the switch circuit comprises a transistor having a control electrode connected to the detection output terminal of the detection subcircuit, a first electrode connected to the power supply terminal, and a second electrode connected to the warner.

Further, the switch circuit comprises a triode having a base connected to the detection output terminal of the detection subcircuit, a collector connected to the warner, and an emitter connected to the power supply terminal.

Further, the warner comprises a buzzer.

Further, the warner comprises a light emitting diode.

Further, the alarm comprises a buzzer and a light emitting diode, the buzzer and the light emitting diode being connected in series.

The present disclosure further provides a chip programming voltage detection method, comprising:

detecting a voltage at a programming voltage output pin of an IC chip;

outputting a detection signal based on the voltage at the programming voltage output pin, the detection signal indicating whether the voltage at the programming voltage output pin reaches a voltage required for an IC chip programming; and issuing a warning alarm in a case where the detection signal indicates that the voltage at the programming voltage output pin does not reach the voltage required for an IC chip programming.

DETAILED DESCRIPTION OF EMBODIMENTS

The exemplary embodiments will be described in detail here, and examples thereof are shown in the accompanying drawings. When the following description refers to the drawings, unless otherwise indicated, the same numbers in different drawings indicate the same or similar elements. The implementation manners described in the following exemplary embodiments do not represent all implementation manners consistent with the present disclosure. Rather, they are merely examples of devices consistent with some aspects of the disclosure as detailed in the appended claims.

Terms used in the present disclosure are only for the purpose of describing specific embodiments and are not intended to limit the present disclosure. Unless otherwise defined, technical terms or scientific terms used in the present disclosure shall have common meanings understood by those of general skills in the art to which the present disclosure pertains. "A" or "one" or other similar words used in the specification and claims of the present disclosure do not mean a quantity limitation, but mean that there is at least one. "Multiple" includes two and is equivalent to at least two. "Comprise/comprising" or "include/including" or other similar words mean that the elements or items existing before "comprise/comprising" or "include/including" cover the elements or items listed after "comprise/comprising" or "include/including" and their equivalents, and do not exclude other elements or objects. "Connecting" or "connected" or other similar words are not limited to physical or mechanical connections, and may include electrical connections, whether direct or indirect. Singular forms of "a", "said" and "the" used in the specification and appended claims of the present disclosure are also intended to include plural forms, unless the context clearly indicates other meanings. It should also be understood that the term "and/or" used herein refers to and includes any or all possible combinations of one or more associated listed items.

Figure 1:
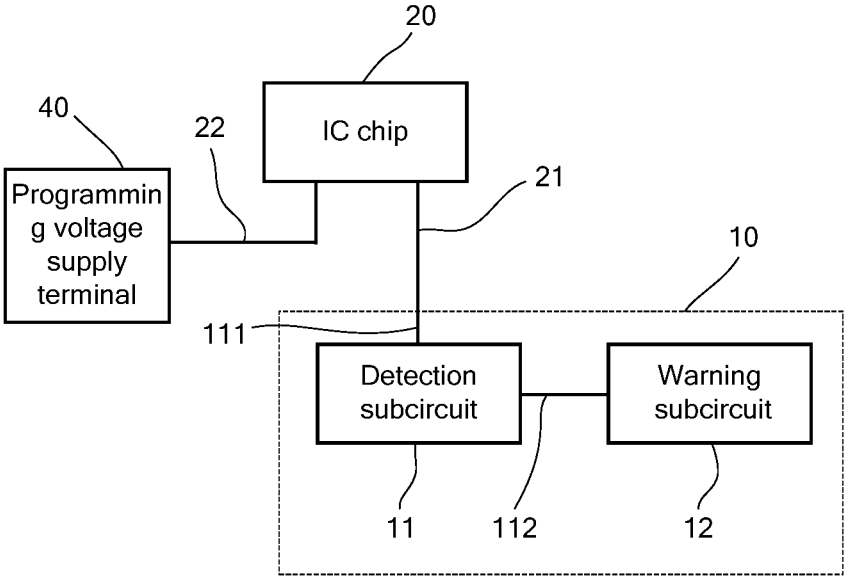
FIG. 1 is a block diagram of a chip programming voltage detection circuit provided by the present disclosure.

FIG. 1 is a block diagram of a chip programming voltage detection circuit 10 provided by the present disclosure. The chip programming voltage detection circuit 10 is used before an IC chip 20 is programmed to detect whether a programming voltage of IC chip 20 meets programming requirements, and to issue a warning alarm to prompt staffs when the programming voltage of IC chip 20 does not meet the programming requirements. As shown in FIG. 1, IC chip 20 includes a programming voltage output pin 21 and a programming voltage input pin 22, and the programming voltage output pin 21 is connected to the programming voltage input pin 22. When IC chip 20 is programmed, a programming voltage supply terminal 40 inputs the programming voltage to the chip through the programming voltage input pin 22, and chip programming voltage detection circuit 10 detects the programming voltage of IC chip 20 through programming voltage output pin 21. In an embodiment, IC chip 20 includes an OTP (One Time Programmable) programming voltage output pin and an OTP programming voltage input pin. In an embodiment, IC chip 20 includes an MTP (Multiple-time Programmable) programming voltage output pin and an MTP programming voltage output pin.

The chip programming voltage detection circuit 10 includes a detection subcircuit 11 and a warning subcircuit 12. The detection subcircuit 11 includes a detection input terminal 111 and a detection output terminal 112. The detection input terminal 111 is connected to the programming voltage output pin 21 of the IC chip 20. A voltage at the programming voltage output pin 21 is detected through the detection input terminal 111, and based on the voltage at the programming voltage output pin 21, a detection signal is output through the detection output terminal 112. In some embodiments, the detection signal indicates whether the voltage at the programming voltage output pin 21 reaches a voltage required for programming the IC chip 20, and the detection signal may be at a high level or a low level. The warning subcircuit 12 is connected to the detection output terminal 112 of the detection subcircuit 11 for receiving the detection signal output by the detection subcircuit 11, and issues a warning alarm in a case where the detection signal indicates that the voltage at the programming voltage output pin 21 does not reach the voltage required for programming the IC chip 20. In an embodiment, that the detection signal output by the detection output terminal 112 is at a high level indicates that the programming voltage of the IC chip 20 does not meet the programming requirements. In another embodiment, that the detection signal output by the detection output terminal 112 is at a low level indicates that the programming voltage of the IC chip 20 does not meet the programming requirements. In some embodiments, in a case where the programming voltage of the IC chip 20 does not meet the programming requirements, the warning subcircuit 12 sends out a warning sound through a buzzer to provide a prompt. In some embodiments, in a case where the programming voltage of the IC chip 20 does not meet the programming requirements, the warning subcircuit 12 provides a prompt by lighting a light emitting diode. In some embodiments, in the case where the programming voltage of the IC chip 20 does not meet the programming requirements, the warning subcircuit 12 sends out a warning sound through a buzzer and simultaneously lights up a light emitting diode to provide a prompt.

The chip programming voltage detection circuit 10 of the present disclosure is connected to the programming voltage output pin 21 of the IC chip 20 to directly detect the programming voltage at the programming voltage output pin 21, and a detection result is output through the detection output terminal 112. There is no need for multiple programming voltage output pins and programming voltage sampling circuit modules. The circuit is simple in structure, small in size, easy to integrate with other test circuits into the same device, and convenient to operate. For example, in an embodiment, the IC chip 20 is integrated into an integrated circuit that performs a specific function. After the integrated circuit is assembled, the integrated circuit needs to be tested, and the chip programming voltage detection circuit 10 can be integrated into the device for testing the integrated circuit. The same device is used both in an integrated circuit test and a programming voltage detection, which avoids inconvenience of changing different test devices in different stages of a test process.

Figure 2A:
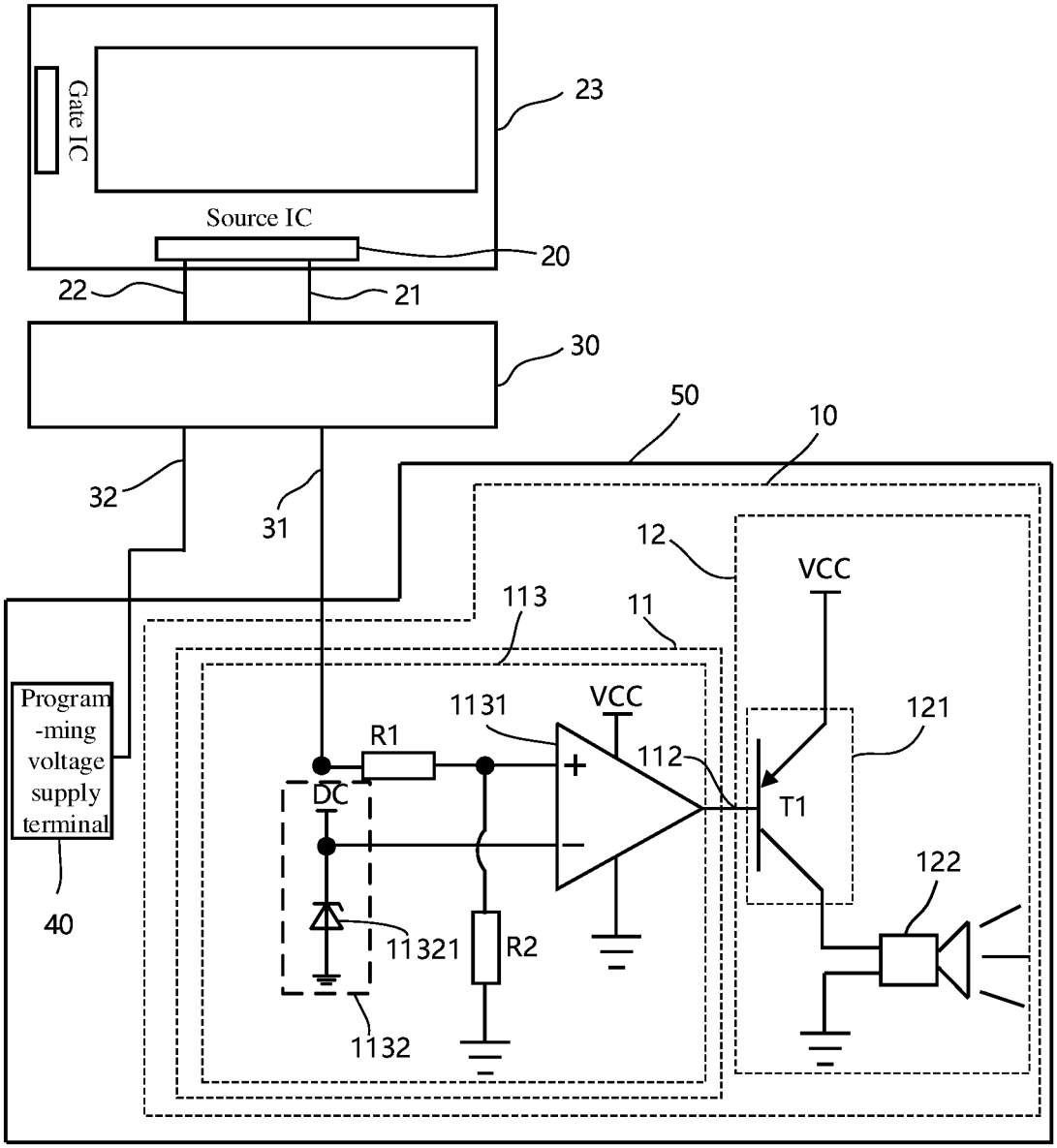
FIG. 2A is a circuit diagram of an embodiment of the chip programming voltage detection circuit shown in FIG. 1.
Figure 2B:
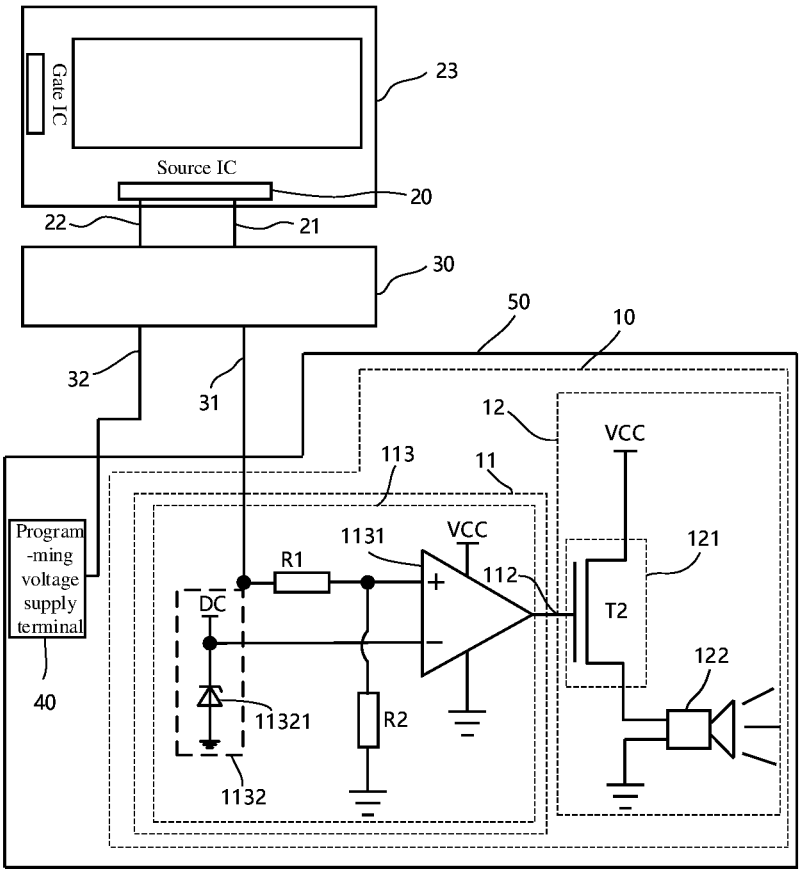
FIG. 2B is a circuit diagram of an embodiment of the chip programming voltage detection circuit shown in FIG. 1.

FIGS. 2A and 2B show a circuit diagram of an embodiment of the chip programming voltage detection circuit 10 shown in FIG. 1. As shown in FIGS. 2A and 2B, in this embodiment, the chip programming voltage detection circuit 10 is provided on a lighting fixture 50 that is pluggable with a driving circuit board 30 for the IC chip 20, and the IC chip 20 is connected to the driving circuit board 30. The lighting fixture 50 is used to perform a lighting test on a display panel 23 where the IC chip 20 is located. The chip programming voltage detection circuit 10 is operated to detect whether the programming voltage of the IC chip 20 reaches the voltage required for programming the IC chip 20 before the display panel 23 performs a data initialization, that is, before programming the IC chip 20, and to issue a warning alarm when the programming voltage of the IC chip 20 does not reach the voltage required for programming. In this embodiment, the chip programming voltage detection circuit 10 is integrated on the lighting fixture 50 that performs a lighting test on the display panel 23. The lighting test on the display panel 23 and the programming voltage detection to the IC chip 20 use the same device, so that the test process is more convenient.

In an embodiment, the driving circuit board 30 includes a first pin 31 and a second pin 32. The first pin 31 is connected to the programming voltage output pin 21 of the IC chip 20 through wiring, and the second pin 32 is connected to the programming voltage input pin 22 of the IC chip 20 through wiring. In an embodiment, the second pin 32 is connected to the programming voltage supply terminal 40 and is used to provide the IC chip 20 with a programming voltage. In an embodiment, the programming voltage provided by the programming voltage supply terminal 40 is 8.6V. The programming voltage supply terminal 40 may be provided on the lighting fixture 50. In some other embodiments, the programming voltage supply terminal 40 may not be provided on the lighting fixture 50. In an embodiment, before the IC chip 20 is programmed, the first pin 31 is connected to the chip programming voltage detection circuit 10 on the lighting fixture 50, and the chip programming voltage detection circuit 10 detects a voltage at the first pin 31 connected to the programming voltage output pin 21 to determine whether the voltage at the first pin 31 reaches the voltage required for programming the IC chip 20. In this embodiment, on the driving circuit board 30, a lead is drawn from the programming voltage output pin 21 of the IC chip 20 to the first pin 31 of the circuit board 30 as a programming voltage detection pin of the IC chip 20. This is because, in one aspect, a voltage at the programming voltage output pin 21 is closer to the programming voltage actually obtained by the IC chip 20, so that the detection result can be more accurate. In another aspect, when the programming voltage is input to the IC chip 20 from the second pin 32 of the circuit board 30, there is voltage loss in the wiring between the second pin 32 and the programming voltage output pin 21 of the IC chip 20. Therefore, if the detection is performed directly on the second pin 32, even if that the programming voltage at the second pin 32 input to the IC chip 20 reaches the voltage required for programming the IC chip 20 is detected, that the voltage obtained at the programming voltage output pin 21 of the IC chip 20 reaches the voltage required for programming the IC chip 20 cannot be guaranteed.

As shown in FIGS. 2A and 2B, in this embodiment, the detection subcircuit 11 includes a voltage comparison circuit 113. The voltage comparison circuit 113 is connected to the first pin 31, that is, the programming voltage output pin 21, and compares a voltage obtained at the first pin 31, that is, the voltage at the programming voltage output pin 21, with a reference voltage. In an embodiment, the reference voltage is set to a standard voltage required for programming the IC chip 20. When the voltage at the programming voltage output pin 21 is greater than the reference voltage, it means that the programming voltage of the IC chip 20 reaches the voltage required for programming. The voltage comparison circuit 113 can output a first detection signal, such as a signal at a high level (a second level). When the voltage at the programming voltage output pin 21 is smaller than the reference voltage, it means that the programming voltage of the IC chip 20 does not reach the voltage required for programming, the voltage comparison circuit 113 outputs a second detection signal, such as a signal at a low level (a first level). The first detection signal and the second detection signal are different, so that the warning subcircuit 12 is controlled differently. The warning subcircuit 12 does not send out a warning alarm when receiving the first detection signal, and sends out a warning alarm when receiving the second detection signal.

In an embodiment, the voltage comparison circuit 113 includes a comparator 1131 and a reference voltage circuit 1132. The comparator 1131 is connected to the first pin 31, that is, the programming voltage output pin 21, and the reference voltage circuit 1132, respectively, to compare the voltage at the first pin 31, that is, the voltage at the programming voltage output pin 21, with the reference voltage. The reference voltage circuit 1132 is used to provide the reference voltage to the comparator 1131. In an embodiment (see FIGS. 2A and 2B), the reference voltage circuit 1132 may include a DC power supply and a Zener diode 11321. A cathode of the Zener diode 11321 is connected to a DC power supply terminal, an anode is connected to a ground terminal, and the comparator 1131 is connected to a node between the cathode of the Zener diode 11321 and the DC power supply terminal. The Zener diode 11321 operates in the reverse breakdown mode, so that a fixed voltage drop across the Zener diode 11321 is provided as the reference voltage. In the reverse breakdown mode, the voltage across the Zener diode 11321 is relatively stable, so that the reference voltage provided by the reference voltage circuit 1132 is relatively stable, which can improve detection accuracy of the voltage comparison circuit 113. In an embodiment, the reference voltage provided by the reference voltage circuit 1132 includes 2.5V. The voltage at the first pin 31, that is, the voltage at the programming voltage output pin 21, is compared with the reference voltage through the comparator 113, which uses fewer electronic devices and is simple in the circuit structure.

In an embodiment, a first input terminal (for example, a positive input terminal) of the comparator 1131 is connected to the first pin 31, that is, the programming voltage output pin 21, and a second input terminal (for example, a negative input terminal) of the comparator 1131 is connected to the reference voltage circuit 1132. An output terminal of the comparator 1131 serves as the detection output terminal of the detection subcircuit 11, and is connected to the warning subcircuit 12 to output the detection signal. The comparator 1131 compares the voltage at the first pin 31, that is, the voltage at the programming voltage output pin 21, with the reference voltage provided by the reference voltage circuit 1132, and then outputs a comparison result to the warning subcircuit 12 through the output terminal.

In an embodiment, the detection subcircuit 11 further includes a first divider resistor R1 and a second divider resistor R2. The first divider resistor R1 and the second divider resistor R2 are connected in series between the first pin 31, that is, the programming voltage output pin 21 and the ground terminal. The first input terminal of the comparator 1131 is connected to a node between the first divider resistor R1 and the second divider resistor R2. The voltage at the first pin 31, that is, the voltage at the programming voltage output pin 21, is divided by the first divider resistor R1 and the second divider resistor R2 and then input into the first input terminal of the comparator 1131. In this way, the voltage at the programming voltage output pin 21 can be prevented from being too high, avoiding damage to the comparator 1131.

In an embodiment, the reference voltage output by the reference voltage circuit 1132 includes a voltage across R2 obtained after the standard voltage required for programming the IC chip 20 is divided by the first divider resistor R1 and the second divider resistor R2, which is defined as Vref herein. In this embodiment, the first divider resistor R1 is connected between the first pin 31, that is, the programming voltage output pin 21 and the first input terminal of the comparator 1131, and the second divider resistor R2 is connected between the first input terminal of the comparator 1131 and the ground terminal. The voltage input into the first input terminal of the comparator 1131 is the voltage across R2 obtained after an actual programming voltage of the IC chip 20 is divided by the first divider resistor R1 and the second divider resistor R2, which is defined as Vin herein. The comparator 1131 compares magnitude of Vref with that of Vin. If Vin is greater than or equal to Vref, it means that the voltage at the programming voltage output pin 21 reaches the voltage required for programming the IC chip 20. If Vin is smaller than Vref, it means that the voltage at the programming voltage output pin 21 does not reach the voltage required for programming the IC chip 20, and the warning subcircuit is used to issue a warning alarm. In an embodiment, when the comparator 1131 detects that the voltage at the first pin 31, that is, the voltage at the programming voltage output pin 21, reaches the voltage required for programming the IC chip 20, it outputs a high level (a second level), conversely, it outputs a low level (a first level).

In an embodiment, resistance of the first divider resistor R1 and the second divider resistor R2 are calculated from the reference voltage output by the reference voltage circuit 1132 and the standard voltage required for programming the IC chip 20. According to previous descriptions, the reference voltage output by the reference voltage circuit 1132 is defined as Vref, the standard voltage required for programming the IC chip 20 is defined as V1, resistance of the first divider resistor R1 is R1, and resistance of the second divider resistor R2 is R2, the reference voltage is calculated according to the following equation:

$$V\text{ref}=V1*(R2/(R1+R2))$$

Further, R2/(R1+R2)=Vref/V1, resistance of the first divider resistor R1 and the second divider resistor R2 can be adjusted, and the two only need to meet above corresponding ratio relationship. The first divider resistor R1 and the second divider resistor R2 have a relatively wide selection range. In an embodiment, if Vref=2.5V and V1=8.6V, then the ratio of the resistance of the first divider resistor R1 and the second divider resistor R2 is: R1/R2=2.44.

In an embodiment, the warning subcircuit 12 includes a switch circuit 121 and an warner 122. Two input terminals of the switch circuit 121 are connected to the detection output terminal 112 of the detection subcircuit 11 and the power supply terminal, respectively. The switch circuit 121 receives the detection signal output by the detection subcircuit 11, and is turned on and off under control of the detection signal, so that the warner 122 issues a warning alarm in a case where the detection signal indicates that the voltage at the programming voltage output pin 21 does not reach the voltage required for programming the IC chip 20. In an embodiment, when the detection signal output by the detection subcircuit 11 is at a low level, it indicates that the voltage at the programming voltage output pin 21 does not reach the voltage required for programming the IC chip 20, and the switch circuit 121 is turned on to trigger the warner 122 to issue a warning alarm. In an embodiment, when the detection signal output by the detection subcircuit 11 is at a high level, it indicates that the voltage at the programming voltage output pin 21 reaches the voltage required for programming the IC chip 20, then the switch circuit 121 is turned off, the warner 122 is not triggered, and no warning alarm is issued. When the programming voltage of the IC chip 20 does not reach the voltage required for programming, the warner 122 is triggered by the switch circuit 121 to issue a warning alarm to prompt staffs, so that the staffs would not perform programming when the programming voltage of the IC chip 20 does not meet the requirements, so as to avoid unstable programming voltage and failure of programming or damage to the IC chip 20.

In an embodiment (see FIG. 2B), the switch circuit 121 includes a transistor T2, a control electrode of the transistor T2 is connected to the detection output terminal 112 of the detection subcircuit 11, a first electrode of the transistor T2 is connected to the power supply terminal VCC, and a second electrode of the transistor T2 is connected to the warner 122.

In an embodiment (see FIG. 2A), the switch circuit 121 includes a triode T1, a base of the triode T1 is connected to the detection output terminal 112 of the detection subcircuit 11, a collector of the triode T1 is connected to the warner 122, and an emitter of the triode T1 is connected to the power supply terminal VCC. In an embodiment, the triode T1 includes a PNP type triode. When the voltage at the programming voltage output pin 21 does not reach the voltage required for programming the IC chip 20, the detection output terminal 112 of the detection subcircuit 11 outputs a low level, the triode T1 is turned on, and the warner 122 is connected to the power supply terminal VCC to issue a warning alarm. When the voltage at the programming voltage output pin 21 reaches the voltage required for programming the IC chip 20, the detection output terminal 112 of the detection subcircuit 11 outputs a high level, then the triode T1 is turned off, the warner 122 is disconnected from the power supply terminal VCC, and no alarm is issued.

In an embodiment, the warner 122 includes a buzzer, and when the voltage at the programming voltage output pin 21 does not reach the voltage required for programming the IC chip 20, the buzzer issues a warning alarm to prompt the staff. In an embodiment, the warner 122 includes a light emitting diode, and when the voltage at the programming voltage output pin 21 does not reach the voltage required for programming the IC chip 20, the light emitting diode is lit up to prompt the staff. In an embodiment, the warner 122 includes a buzzer and a light emitting diode, and the buzzer and the light emitting diode are connected in series. In the case where the voltage at the programming voltage output pin 21 does not reach the voltage required for programming the IC chip 20, the buzzer issues a warning alarm and the light emitting diode is lit up, so as to prompt the staff. According to the embodiment, in a case where the programming voltage of the IC chip 20 does not meet the programming requirements, the warner 122 provides real-time and automatic prompts without manual monitoring, which saves testing time.

The chip programming voltage detection circuit 10 provided by the present disclosure has a simple circuit structure and a small size, and may be integrated with other test circuits into the same test device, and it is more convenient to use.

Figure 3:
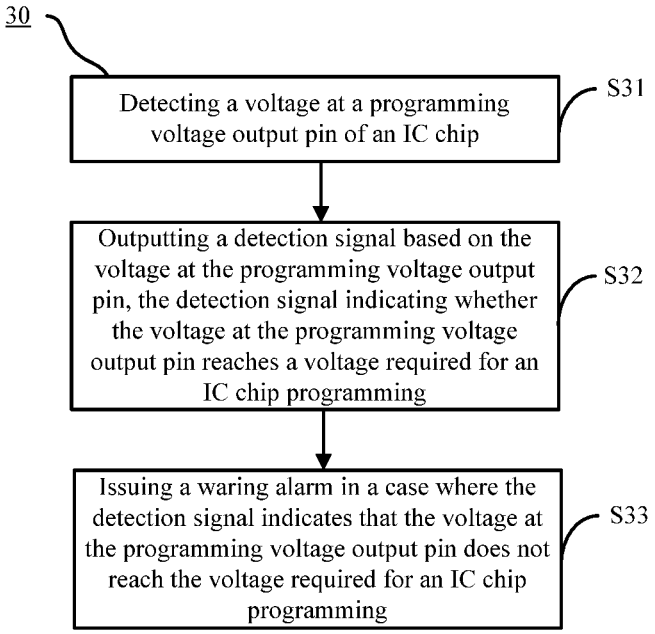
FIG. 3 is a flowchart of a chip programming voltage detection method provided by the present disclosure.

In an embodiment, the present disclosure further provides a chip programming voltage detection method based on the chip programming voltage detection circuit 10 of foregoing embodiments. FIG. 3 is a flowchart of the chip programming voltage detection method provided by the present disclosure. As shown in FIG. 3, the chip programming voltage detection method 30 includes the following steps:

In step S31, a voltage at a programming voltage output pin of an IC chip is detected.

In step S32, a detection signal is output based on the voltage at the programming voltage output pin, and the detection signal indicates whether the voltage at the programming voltage output pin reaches a voltage required for an IC chip programming.

In step S33, a warning alarm is issued when the detection signal indicates that the voltage at the programming voltage output pin does not reach the voltage required for an IC chip programming.

Above descriptions are only preferred embodiments of the present disclosure and are not intended to limit the present disclosure. Any modification, equivalent replacement, improvement, and the like, made within the spirit and principle of the present disclosure shall be included in the scope of protection of the present disclosure.

What is claimed is:

1. An electronic device, comprising:

a display panel comprising an IC chip, wherein the IC chip comprises a programming voltage output pin and a programming voltage input pin;

a driving circuit board comprising a first pin and a second pin, wherein the first pin is connected to the programming voltage output pin of the IC chip through wiring, and the second pin is connected to the programming voltage input pin of the IC chip through wiring;

a programming voltage supply terminal connected to the driving circuit board through the second pin;

a chip programming voltage detection circuit comprising:

a detection subcircuit comprising a detection input terminal connected to the driving circuit board through the first pin and a detection output terminal, and operable to detect a voltage at the programming voltage output pin through the detection input terminal, and output a detection signal through the detection output terminal based on the voltage at the programming voltage output pin, the detection signal indicating whether the voltage at the programming voltage output pin reaches a voltage required for programming of the IC chip; and a warning subcircuit connected to the detection output terminal of the detection subcircuit, and operable to receive the detection signal output by the detection subcircuit and issue a warning alarm in response to the detection signal indicating that the voltage at the programming voltage output pin does not reach the voltage required for programming of the IC chip, wherein the detection subcircuit comprises a voltage comparison circuit connected to the driving circuit board through the first pin, the voltage comparison circuit comprising:

a reference voltage circuit that provides a reference voltage; and a comparator having a first input terminal connected to the first pin, a second input terminal connected to the reference voltage circuit, and an output terminal serving as the detection output terminal to output the detection signal, wherein the comparator is configured to compare the voltage at the programming voltage output pin with the reference voltage; and a lighting fixture pluggable with the driving circuit board and configured to perform a lighting test on the display panel, wherein the chip programming voltage detection circuit and the programming voltage supply terminal are provided on the lighting fixture.

2. The electronic device of claim 1, wherein the detection subcircuit further comprises a first divider resistor and a second divider resistor connected in series between the programming voltage output pin and a ground terminal, a node between the first divider resistor and the second divider resistor being connected to the first input terminal of the comparator.

3. The electronic device of claim 2, wherein the reference voltage is determined according to the following equation:

$$V\text{ref}=V1*(R2/(R1+R2)),$$

in which Vref represents the reference voltage, V1 represents the voltage required for programming of the IC chip, R1 represents resistance of the first divider resistor, and R2 represents resistance of the second divider resistor.

4. The electronic device of claim 3, wherein the comparator is further configured to output the detection signal with a first level to enable the warning subcircuit to issue the warning alarm in response to the voltage at the programming voltage output pin being smaller than the reference voltage.

5. The electronic device of claim 1, wherein the reference voltage circuit comprises:

a DC power supply configured to provide a DC supply voltage to a Zener diode; and the Zener diode having a cathode connected to the DC power supply and the second input terminal of the comparator and an anode connected to a ground terminal.

6. The electronic device of claim 1, wherein the warning subcircuit comprises:

a switch circuit having an input terminal connected to the detection output terminal of the detection subcircuit and a power supply terminal, and configured to receive the detection signal and be turned on under control of the detection signal to provide a supply voltage of the power supply terminal to a warner; and the warner connected to an output terminal of the switch circuit, and configured to issue the warning alarm under control of the switch circuit.

7. The electronic device of claim 6, wherein the switch circuit comprises a transistor having a control electrode connected to the detection output terminal of the detection subcircuit, a first electrode connected to the power supply terminal, and a second electrode connected to the warner.

8. The electronic device of claim 6, wherein the switch circuit comprises a triode having a base connected to the detection output terminal of the detection subcircuit, a collector connected to the warner, and an emitter connected to the power supply terminal.

9. The electronic device of claim 6, wherein the warner comprises a buzzer.

10. The electronic device of claim 6, wherein the warner comprises a light emitting diode.

11. The electronic device of claim 6, wherein the warner comprises a buzzer and a light emitting diode, the buzzer and the light emitting diode being connected in series.

12. A chip programming voltage detection method applied to the IC chip that comprises the programming voltage output pin using the electronic device of claim 1, comprising:

detecting the voltage at the programming voltage output pin of the IC chip;

outputting the detection signal based on the voltage at the programming voltage output pin, the detection signal indicating whether the voltage at the programming voltage output pin reaches the voltage required for programming of the IC chip; and issuing the warning alarm in response to the detection signal indicating that the voltage at the programming voltage output pin does not reach the voltage required for programming of the IC chip.

* * * * *